US011002233B1

(12) United States Patent
Hajialimohammadi et al.

(10) Patent No.: US 11,002,233 B1
(45) Date of Patent: May 11, 2021

(54) SINGLE-FLUID COMMON RAIL FUEL INJECTOR WITH FUEL RECOVERY FITTING AND ENGINE SYSTEM USING SAME

(71) Applicant: Caterpillar Inc., Peoria, IL (US)

(72) Inventors: Goudarz Hajialimohammadi, Bloomington, IL (US); Manjunath Bannur Nagaraja, Naperville, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 16/699,310

(22) Filed: Nov. 29, 2019

(51) Int. Cl.
*F02M 37/00* (2006.01)
*F02M 63/00* (2006.01)
*F02M 61/14* (2006.01)

(52) U.S. Cl.
CPC ..... *F02M 37/0052* (2013.01); *F02M 61/14* (2013.01); *F02M 63/0029* (2013.01); *F02M 2200/701* (2013.01)

(58) Field of Classification Search
CPC ..... F02M 37/0052; F02M 37/0017; F02M 37/007; F02M 61/14; F02M 63/0029
See application file for complete search history.

(56) References Cited

U.S. PATENT DOCUMENTS 5,890,471 A * 4/1999 Nishimura ..... F02M 45/12 123/467
6,378,497 B1 4/2002 Keyster et al.
7,111,614 B1 9/2006 Coldren et al.
7,475,674 B2 * 1/2009 Marksteiner ..... F02M 55/002 123/468
9,163,597 B2 10/2015 Manubolu et al.
2003/0194326 A1 * 10/2003 Bettenhausen ..... F04B 51/00 417/53
2004/0211394 A1 * 10/2004 Yager ..... F02M 55/002 123/468
2006/0107928 A1 * 5/2006 Houy ..... F04F 5/46 123/469
2011/0290211 A1 * 12/2011 Coldren ..... F02M 45/08 123/299
2020/0182185 A1 * 6/2020 Hoover ..... F02M 55/002

FOREIGN PATENT DOCUMENTS

WO 0118382 A1 3/2001

* cited by examiner

*Primary Examiner* — Sizo B Vilakazi
*Assistant Examiner* — Anthony L Bacon
(74) *Attorney, Agent, or Firm* — Brannon Sowers & Cracraft

(57) ABSTRACT

An internal combustion engine system includes an engine head, a pressurized fuel supply conduit, and a fuel return conduit. Fuel injectors are positioned in fuel injector bores in the engine head, and each include an intensifier plunger, a nozzle check, an injection control valve, and an intensifier control valve. Fuel recovery fittings are coupled to the plurality of fuel injectors and each fluidly connect an actuation fuel outlet in one of the fuel injectors to the fuel return conduit.

19 Claims, 4 Drawing Sheets

SINGLE-FLUID COMMON RAIL FUEL INJECTOR WITH FUEL RECOVERY FITTING AND ENGINE SYSTEM USING SAME

TECHNICAL FIELD

The present disclosure relates generally to a common rail fuel system in an internal combustion engine, and more particularly to single-fluid common rail fuel injector assembly having a fuel recovery fitting.

BACKGROUND

Modern fuel systems used in internal combustion engines are typically relatively complex and highly sophisticated apparatus having many moving parts, and are required to handle high absolute pressures, as well as rapid pressure swings during operation. Engineers have discovered that precise control over fuel injection characteristics, including injection pressure, injection timing, injection rate shape, and other factors can have beneficial impacts on engine emissions. For example, it has been observed that a small pilot injection followed by a subsequent main injection can assist in promoting relatively rapid and complete combustion of a fuel charge in an engine cycle. Post injections, where a small injection follows a larger main injection, can also have beneficial impacts in certain circumstances. Fuel injection rate shape, referring to the shape of a signal trace reflecting fuel injection rate, can also be varied amongst square, ramp, and other shapes, to varying effect.

The implementation and control of pilot injections, post injections, rate shapes, and other fuel injection properties can differ based upon the basic design of fuel injectors and fuel systems. Where mechanical actuation of a fuel injector is employed, spill valves that selectively open to spill pressure during a plunger pressurization event in a fuel injector are commonly used to provide desired fuel injection characteristics. In other fuel systems, for example, common rail fuel systems where pressurized fuel is continuously available within a fuel injector, different strategies are used to control or vary injection properties. In the context of common rail fuel systems, success in rate shaping has been elusive, required unduly complex fuel injector designs, an injector actuation fluid different from the fuel that is injected, or presented still other challenges. U.S. Pat. No. 7,111,614 to Coldren et al. is directed to a known single-fluid injector apparently having rate shaping capability.

SUMMARY OF THE INVENTION

In one aspect, an internal combustion engine system includes an engine head having formed therein a plurality of fuel injector bores, a fuel supply including a pressurized fuel supply conduit, and a fuel return conduit fluidly connected to the fuel supply. The engine system further includes a plurality of fuel injectors positioned in the plurality of fuel injector bores. Each of the plurality of fuel injectors has formed therein an actuation fuel supply passage fluidly connected to the pressurized fuel supply conduit, a pressure control passage, a plunger control passage, a nozzle fuel supply passage extending between a plunger cavity and a nozzle outlet, and at least one actuation fuel outlet. Each of the plurality of fuel injectors further includes an intensifier plunger, a nozzle check, an injection control valve, and an intensifier control valve. A plurality of fuel recovery fittings are coupled to the plurality of fuel injectors and each fluidly connects the at least one actuation fuel outlet in the respective fuel injector to the fuel return conduit.

In another aspect, a fuel injector assembly includes an injector housing having formed therein an actuation fuel supply passage, a pressure control passage, an intensifier passage, a nozzle fuel supply passage extending between a plunger cavity and a nozzle outlet, and at least one actuation fuel outlet. The fuel injector assembly further includes an intensifier plunger having an actuation surface exposed to the intensifier passage, and a pressurization surface exposed to the plunger cavity. The fuel injector assembly also includes a nozzle check movable between a closed check position blocking the nozzle outlet, and an open check position, and having a closing hydraulic surface exposed to a fluid pressure of the pressure control passage. An injection control valve is movable between a first control valve position, where the pressure control passage is fluidly connected to the actuation fuel supply passage, and a second control valve position, where the pressure control passage is blocked from the actuation fuel supply passage and fluidly connected to the at least one actuation fuel outlet. The fuel injector assembly further includes an intensifier control valve, and a fuel recovery fitting, having a recovered fuel outlet coupled to the injector housing and fluidly connecting the at least one actuation fuel outlet to the recovered fuel outlet.

In still another aspect, a method of operating a common rail fuel system in an internal combustion engine includes moving a control valve in a fuel injector between a first control valve position and a second control valve position to vary a pressure of fuel in a pressure control passage in the fuel injector. The method further includes opening a nozzle check in the fuel injector based on a reduction in the pressure of fuel in the pressure control passage caused by the moving of the control valve, and varying a flow of fuel to a spool valve in the fuel injector based on the varying of the pressure of fuel in the pressure control passage. The method still further includes varying a rate of advancement of an intensifier plunger through a plunger cavity in the fuel injector based on the varied flow of fuel through the spool valve, and injecting fuel from the plunger cavity through a nozzle outlet in the fuel injector opened by the opening of the nozzle check at a fuel injection rate having a rate shape that is based on the varied rate of advancement of the intensifier plunger. The method still further includes recovering fuel from at least one actuation fuel outlet of the fuel injector in a fuel recovery fitting coupled with the fuel injector.

DETAILED DESCRIPTION

Figure 1:
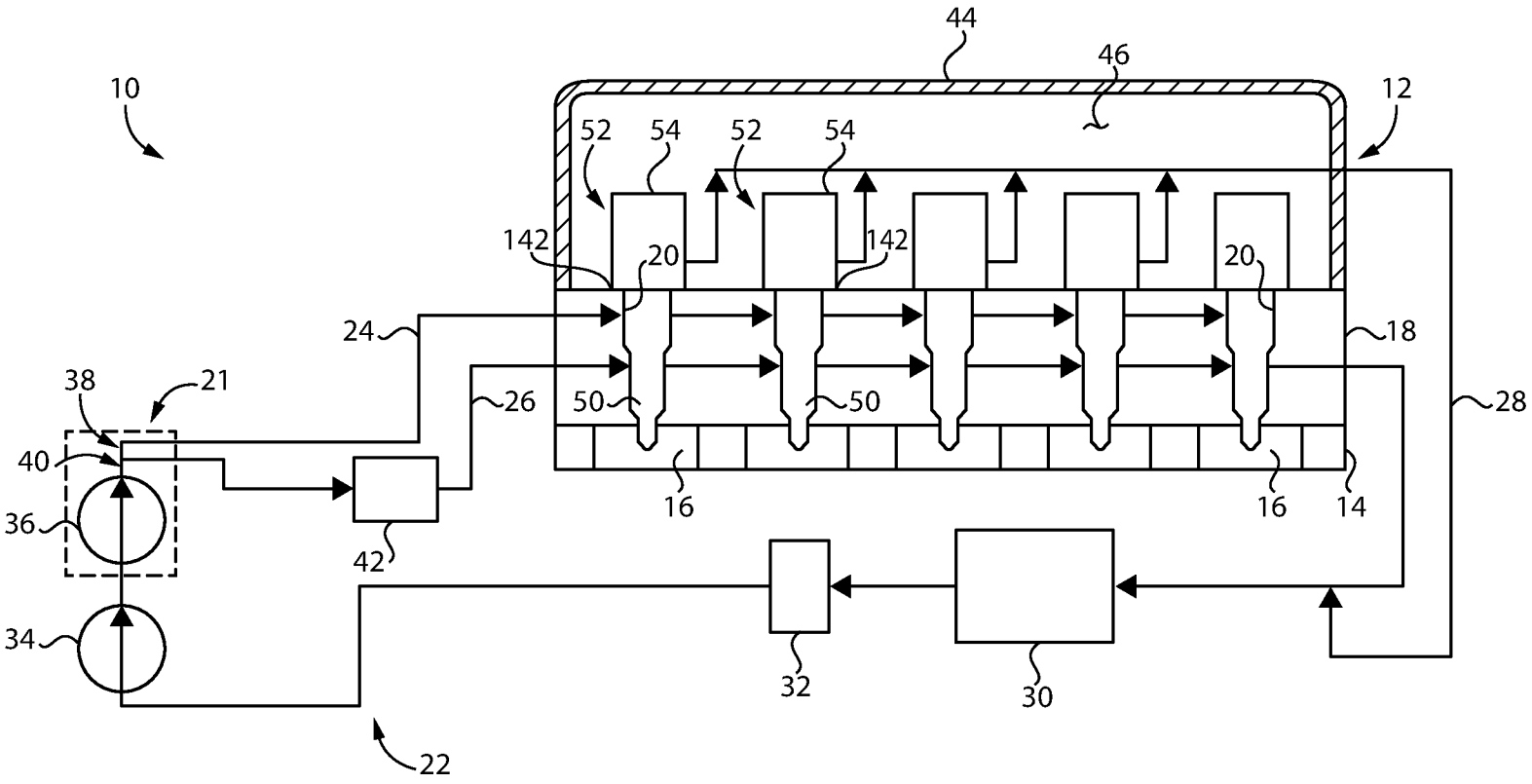
FIG. 1 is a diagrammatic view of an engine system, according to one embodiment.

Referring to FIG. 1, there is shown an internal combustion engine system 10 according to one embodiment. Internal combustion engine system 10 (hereinafter "engine system 10") includes an engine 12 having a cylinder block 14 with a plurality of cylinders 16 formed therein. Engine 12 can include a compression-ignition diesel engine, however, the present disclosure is not thereby limited. Engine 12 further includes an engine head 18 coupled to cylinder block 14 and having formed therein a plurality of fuel injector bores 20. A fuel system 21 is coupled to engine 12 and includes a fuel supply 22 having a pressurized fuel supply conduit 24. Pressurized fuel supply conduit 24 can include a higher pressure fuel supply conduit, and fuel system 21 also includes a lower pressure fuel supply conduit 26, and a still lower pressure fuel return conduit 28 fluidly connected to fuel supply 22. Fuel system 21 also includes a fuel tank 30, a fuel filter 32, and a fuel transfer pump 34 structured to supply fuel having passed through filter 32 to a fuel pressurization pump 36.

Fuel pressurization pump 36 could include an inlet-metered pump, an outlet-metered pump, or still another type of pump structured to pressurize fuel for actuating components in fuel system 21 and providing fuel for injection, as further discussed herein. In the illustrated embodiment fuel pressurization pump 36 includes a higher pressure outlet 38 and a lower pressure outlet 40 structured to feed fuel to fuel supply conduit 24 and fuel supply conduit 26, respectively. One or more additional fuel filters 42 may be positioned fluidly between fuel pressurization pump 38 and engine head 18, for example in fuel supply conduit 26. Also in the illustrated embodiment fuel supply conduit 24 and fuel supply conduit 26 feed fuel through cylinder block 14 by way of passages and/or connectors located in cylinder block 14 and/or engine head 18. Fuel supply conduit 24 can be understood as a common rail. Common rail is intended herein to refer to any of a number of different fuel containment and supply strategies where a single pressurized fuel reservoir is employed to maintain fuel at a desired pressure for supplying to multiple different fuel injectors. Fuel supply conduit 24 may be maintained at a lower pressure than in other common rail systems, as pressurization to an injection pressure takes place within fuel injectors as further discussed herein. Quill connectors, pressure sensors, relief valves, or other known pressurized fuel supply connections and monitoring or control hardware may be provided in engine system 10, as will be understood to those skilled in the art.

A valve cover 44 is also attached to engine head 18, such that a space 46 is formed between valve cover 44 and engine head 18. Engine system 10, and fuel system 21, also includes a plurality of fuel injectors 50 in a plurality of fuel injector assemblies 52 positioned in the plurality of fuel injector bores 20. Fuel injector assemblies 52 each also include a fuel recovery fitting 54 coupled to the corresponding one of the plurality of fuel injectors 50. A plurality of fuel seals 142 are formed between the plurality of fuel recovery fittings 54 and the respective fuel injectors 50, and also potentially between fuel recovery fittings 54 and engine head 18 as further discussed herein. Each of the plurality of fuel recovery fittings 54 may be positioned at least partially within space 46. Engine oil supplied directly or incidentally into space 46 could contact fuel recovery fittings 54 to assist in cooling.

Figure 2:
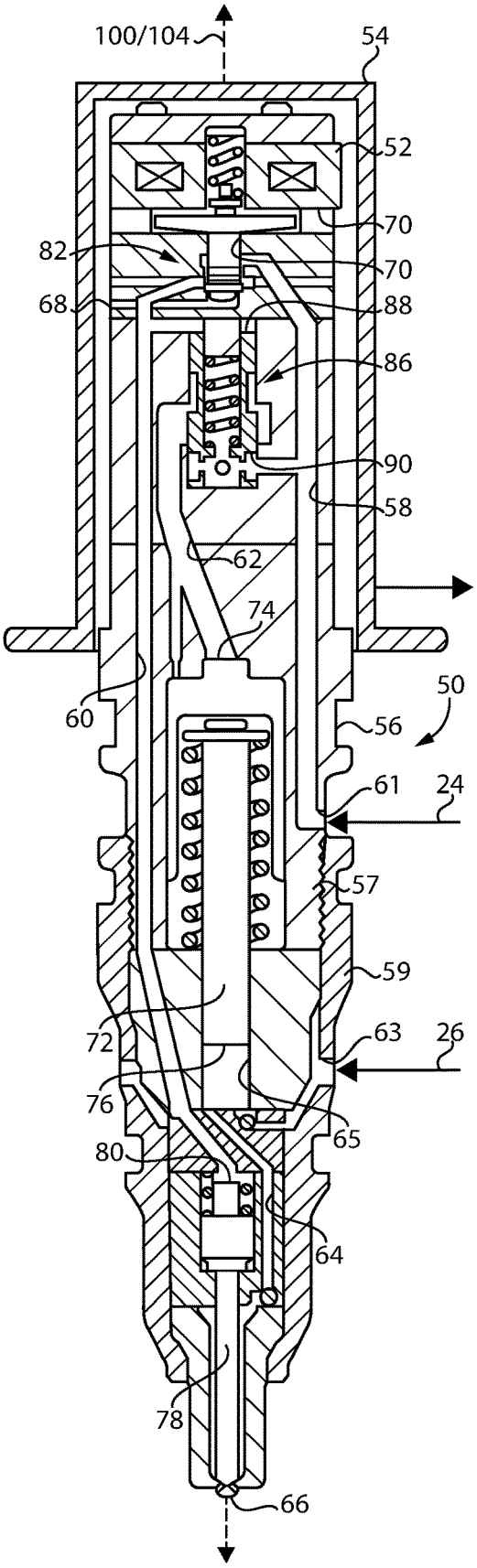
FIG. 2 is a sectioned side diagrammatic view of a fuel injector assembly, according to one embodiment.

Referring also now to FIG. 2, there are shown features of one of fuel injector assemblies 52, hereinafter referred to in the singular, in greater detail. Fuel injector assembly 52 includes fuel injector 50 and fuel recovery fitting 54 as noted above. Fuel injector 50 also includes an injector housing 56 having formed therein an actuation fuel supply passage 58, a pressure control passage 60, an intensifier passage 62, a nozzle fuel supply passage 64 extending between a plunger cavity 65 and a nozzle outlet 66, and at least one actuation fuel outlet 68 and 70. Injector housing 56 includes a number of different injector housing components and, in the illustrated embodiment, an injector body 57 coupled to a casing 59, for example by way of a threaded connection. Injector body 57 can be screwed into casing 59 to clamp together components in injector housing 56 in a generally known manner. The at least one actuation fuel outlet can include a drain port 68, and a fuel leakage path 70. Fuel injector 50 also includes an intensifier plunger 72 having an actuation surface 74 exposed to intensifier passage 62, and a pressurization surface 76 exposed to plunger cavity 65. A nozzle check 78 is movable within injector housing 56 between a closed check position blocking nozzle outlet 66, and an open check position at which nozzle outlet 66 is not blocked. Nozzle check 78 may be directly controlled and includes a closing hydraulic surface 80 exposed to a fluid (fuel) pressure of pressure control passage 60. Fuel injector 50 also includes an injection control valve 82 movable between a first control valve position, where pressure control passage 60 is fluidly connected to actuation fuel supply passage 58, and a second control valve position, where pressure control passage 60 is blocked from actuation fuel supply passage 58. At the second control valve position pressure control passage 60 is fluidly connected to the at least one actuation fuel outlet, namely, drain port 68.

Injection control valve 82 may be part of a control valve subassembly 118 including a valve body 120 and a valve member, such as a poppet valve member 122, movable relative to valve body 120 to contact a lower seat 124 or an upper seat 126 at the first control valve position and the second control valve position, respectively. A biaser 128, such as a conventional biasing spring, biases valve member 122 toward the second control valve position. An electrical actuator 130, such as a solenoid electrical actuator, is provided and can be varied in electrical energy state to move valve member 122 in opposition to a bias of biaser 128 from the first control valve position to the second control valve position.

Fuel injector 50 also includes an intensifier control valve 86. In a practical implementation strategy, intensifier control valve 86 includes a spool valve having a first end surface 88 and a second end surface 90. First end surface 88 can be exposed to a fluid pressure of pressure control passage 60, and second end surface 90 can be exposed to a fluid pressure of actuation fuel supply passage 58. By varying a position of injection control valve 82, fluid connections amongst pressure control passage 60, actuation fuel supply passage 58, and drain port 68 can be varied. Lower seat 124 may be a three-way valve seat formed in injector housing 56 and positioned fluidly amongst pressure control passage 60, actuation fuel supply passage 58, and drain port 68. Thus, injection control valve 82, namely, valve member 122, blocks three-way valve seat 124 at the first control valve position, and does not block valve seat 124 at the second control valve position.

Those skilled in the art will be familiar with certain related aspects of functionality of a pilot control valve, such as injection control valve 82, and a slide-type hydraulic valve, such as intensifier control valve 86. During, or in preparation for, a fuel injection event, injection control valve 82 can be opened and closed multiple times to vary a pressure acting upon first end surface 88 by way of varied pressure in pressure control passage 60. When a fuel pressure of actuation fuel supply passage 58 is acting on both end surface 88 and end surface 90 of intensifier control valve 86, intensifier control valve 86 may be balanced, and positioned such that intensifier control passage 62 is at a lower pressure, such as a drain pressure, and such that intensifier plunger 72 is retracted, approximately as shown in FIG. 2. When first end surface 88 is exposed to a lower fluid pressure, such as where injection control valve 82 is actuated open, the higher fuel pressure prevailing in actuation fuel supply passage 58 can cause intensifier control valve 86 to move, upward in the FIG. 2 illustration, to provide high pressure flow through and/or around intensifier control valve 86 to increase pressure of and provide a flow of fuel into intensifier control passage 62. As a result, intensifier plunger 72 can advance, downward in the FIG. 2 illustration, through plunger cavity 65. By exploiting the aforementioned opening and closing of injection control valve 82 in anticipation of, or during, a fuel injection event, the rate of advancement of intensifier plunger 72 through plunger cavity 65 can be varied to vary injection rate shape as further discussed herein. It will thus be understood that injection control valve 82 may be thought of as controlling multiple hydraulic fuel circuits by moving between lower seat 124 and upper seat 126. As also shown in the illustrated embodiment, injector housing 56 further has formed therein an actuation fuel inlet 61 fluidly connected to fuel supply conduit 24 within engine head 18. Injector housing 56 also includes a nozzle fuel inlet 63, separate from actuation fuel inlet 61, and fluidly connected to nozzle fuel supply passage 64, and to fuel supply conduit 26 within engine head 18.

Figure 3:
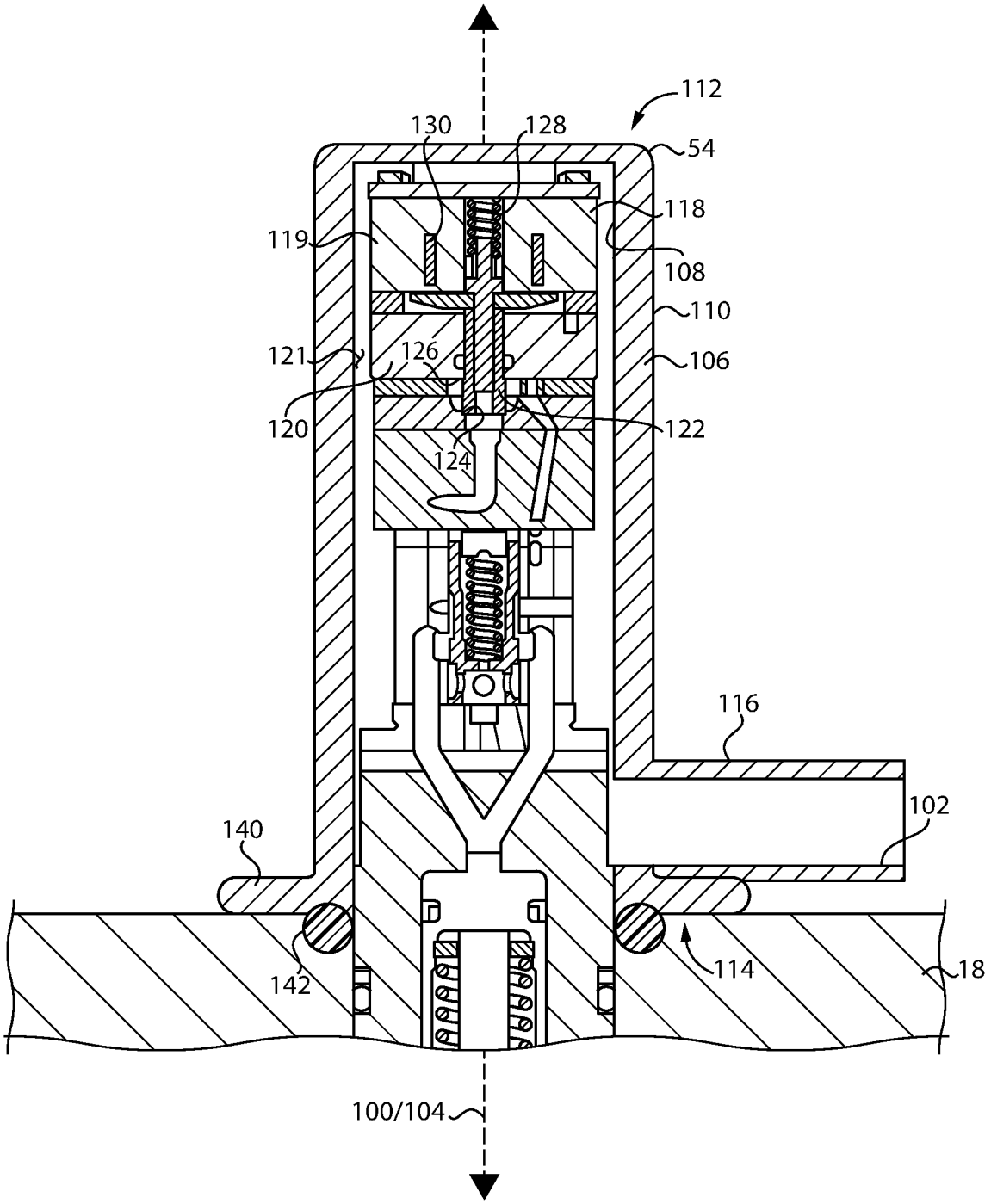
FIG. 3 is a sectioned side diagrammatic view of a portion of the engine system of FIG. 1.

FIG. 3 also shows additional features of fuel recovery fitting 54. Fuel recovery fitting 54 may be coaxially arranged with injector housing 56. Injector housing 56 defines a longitudinal injector axis 100, and fuel recovery fitting 54 defines a longitudinal fitting axis 104. The axes 100 and 104 are shown co-linear in the drawings. Fuel recovery fitting 54 also includes a sleeve portion 106 that is coaxially arranged with injector housing 56. Sleeve portion 106 includes an inside surface 108. Fuel recovery fitting 54 also includes a projecting side tube 116 having a recovered fuel outlet 102 formed therein. Recovered fuel outlet 102 may fluidly connect to fuel return conduit 28. Accordingly, the plurality of fuel recovery fittings 54 may fluidly connect in parallel to fuel return conduit 28. Fuel return conduit 28 may feed recovered fuel from actuating injection control valve 82, to fuel tank 30. In FIG. 1 the location of returning recovered fuel to fuel supply 22 by way of fuel return conduit 28 is upstream of fuel tank 30. In another embodiment, fuel return conduit 28 could connect to an inlet to transfer pump 34, or potentially to an inlet to fuel pressurization pump 36. It is contemplated that some fuel pressure may be maintained in fuel recovery fitting 54 that is greater than atmospheric pressure. Accordingly, an efficiency gain may be realized in that fuel, having already been filtered, can be supplied to fuel pressurization pump 36 at a slightly elevated pressure than were the fuel supplied directly from fuel tank 30, which will typically be at atmospheric pressure.

It will be recalled that injection control valve 82 may be part of a control valve subassembly 118. Control valve subassembly 118 may have an outside surface 119, and a fuel collection cavity 121 extends between inside surface 108 of sleeve portion 106 and outside surface 119 of control valve subassembly 118. It will also be recalled the at least one actuation fuel outlet can include drain port 68 and also leakage path 70. During moving valve member 122 some pressurized fuel can be expected to leak through a clearance between valve body 120 and valve member 122, and find its way outside of injector housing 56. Fuel collection cavity 121 is simultaneously fluidly connected with leakage path 70 and drain port 68. Continued expelling of pressurized fuel into fuel collection cavity 121 can be expected to assist in maintaining a flow of fuel from the respective fuel recovery fitting 54 of each fuel injector 50 to fuel return conduit 28. The flow of fuel can also assist in cooling control valve subassembly 118. Fuel seal 142 may fluidly seal amongst engine head 18, fuel injector 50, and fuel recovery fitting 54. In the illustrated embodiment, injector body 57 has plunger cavity 65 formed therein, and fuel seal 142 fluidly seals between fuel recovery fitting 54 and injector body 57. In particular, fuel recovery fitting 54 includes a radially projecting flange 140, and fuel seal 142 may seal with flange 140 and with fuel injector 50, including injector body 57, and with engine head 18.

Figure 4:
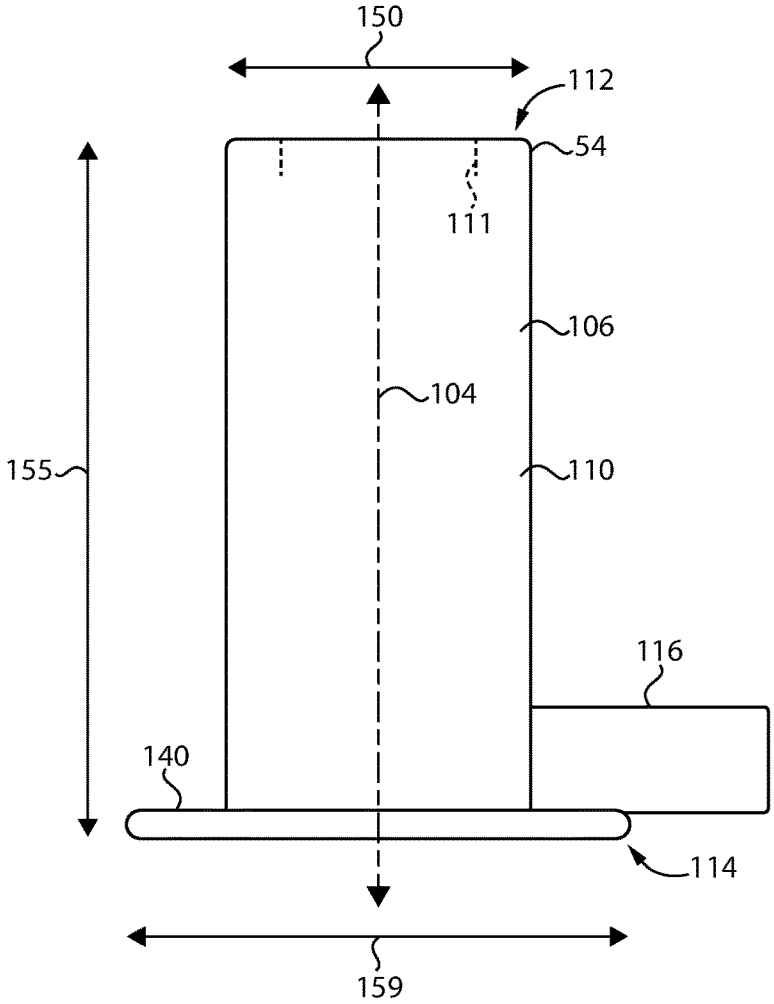
FIG. 4 is a side diagrammatic view of a fuel recovery fitting, according to one embodiment.

Referring also now to FIG. 4, there are shown some additional features of fuel recovery fitting 54. Fuel recovery fitting 54 has a first axial end 112 and a second axial end 114, with projecting side tube 116 being positioned adjacent to second axial end 114. Second axial end 114 includes flange 140. First axial end 112 may include an opening 111 formed therein for accommodating electrical connections for electrical actuator 130, and fluidly sealed with injector housing 56 around opening 111. In one implementation, fuel recovery fitting 54 can be threadedly engaged with fuel injector 50, such as by threaded engagement with injector body 57. In other instances, fuel recovery fitting 54 might be attached by some other mechanism to fuel injector 50, for example a snap-fit or other interference fit, or potentially attached to engine head 18. Fuel recovery fitting 54 further includes an outer diameter dimension 150, an axial length dimension 155, and a flange outer diameter dimension 159. An outer surface 110 of fuel recovery fitting 54 may be substantially cylindrical and extends circumferentially around longitudinal fitting axis 104. Flange 140 may also be shaped so as to extend radially outward from sleeve portion 106, and having an outer perimeter defining a circle centered on fitting longitudinal axis 104. Axial length dimension 155 may be greater than outer diameter dimension 150, such as by a factor of 2-3, or more. Axial length dimension 155 may also be greater than flange outer diameter dimension 159, for example 1.5 times greater, or more. Side tube 116 may extend generally perpendicular to axis 104 to a location that is radially outward of flange 140.

INDUSTRIAL APPLICABILITY

Referring to the drawings generally, operating fuel system 31 in engine system 10 can include moving control valve 82 between its first control valve position and second control valve position, to vary a pressure of fuel in pressure control passage 60 as discussed herein. Nozzle check 78 is opened based on a reduction in the pressure of fuel in pressure control passage 60 caused by the moving of control valve 82. As discussed above, intensifier control valve 86 is adjusted to vary a flow of fuel therethrough based on the varying of the pressure of fuel in pressure control passage 60. As also discussed herein, a rate of advancement of intensifier plunger 72 through plunger cavity 63 is varied based on the varied flow of fuel through intensifier control valve 86. With nozzle check 78 opened, fuel from plunger cavity 65 is injected through nozzle outlet 66 at a fuel injection rate having a rate shape that is based on the varied rate of advancement of intensifier plunger 72.

Embodiments are contemplated where injection control valve 82 is moved multiple times to open and close seat 124, with intensifier control valve 86 correspondingly accelerated, decelerated, reversed, stopped, or fully opened and then fully closed, all during, or in anticipation of, a single injection cycle. Accordingly, pressure and flow of fuel in intensifier passage 62 can be varied in a manner that produces numerous different fuel injection rate shapes. The fuel leaked through leakage path 70, and fuel expelled through drain port 68, is recovered by way of fuel recovery fitting 54 in fuel collection cavity 108, and returned to fuel supply 22 as discussed herein.

Figure 5:
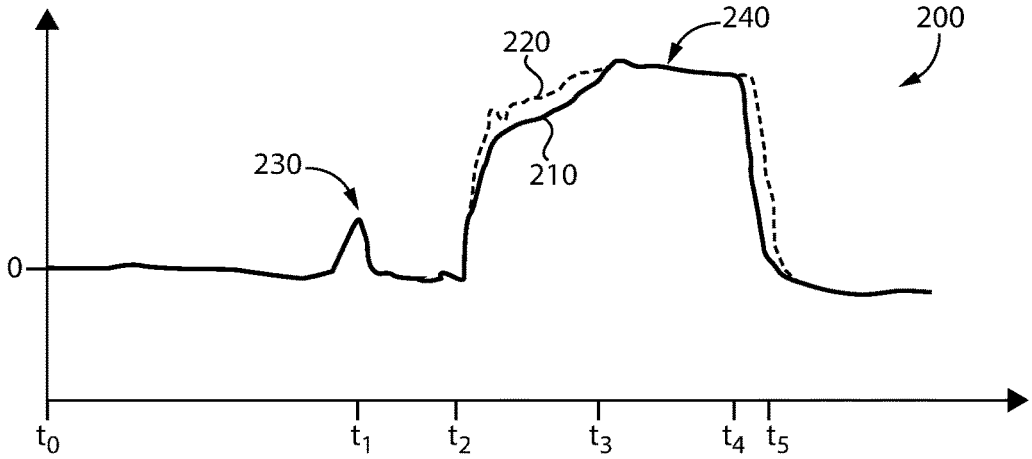
FIG. 5 is a rate trace showing example fuel injection rate shaping characteristics, according to one embodiment.

Referring now to FIG. 5, there is shown a graph 200 illustrating example rate shaping that can be produced in a fuel injection, according to the present disclosure. A first trace is shown at 210, and illustrates an example ascending ramp shape in a main fuel injection 240. A second trace is shown at 220 and illustrates a different ascending ramp shape that might be produced in main injection 240. An area between trace 210 and trace 220, between a time $t_2$ and a time $t_3$, represents rate shapes that could be varied essentially infinitely using fuel system 21. At a time $t_4$, trace 210 drops towards zero, illustrating fuel injection cut-off. Trace 220 drops back towards zero at approximately a time $t_5$. Again, a timing, and potentially a shape, of end of injection rate could be varied between the shapes of trace 210 and trace 220 essentially infinitely. A pilot injection 230 is shown at about a time $t_1$ by way of reference number 230. In addition to the pilot shot, ascending ramp rate shape, and injection cut-off variations shown in FIG. 5, post injections, square injections, multiple pilot shots, multiple post shots, and still other flexibility is anticipated in view of the present disclosure. It will also be appreciated that this flexibility in rate shaping using fuel system 21 is possible in a single-fluid injector, using fuel for both injection and actuation. Such capabilities contrast from other strategies where pressurized engine oil, or another fluid, is used for actuation while fuel itself is injected.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims. As used herein, the articles "a" and "an" are intended to include one or more items, and may be used interchangeably with "one or more." Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise.

What is claimed is:

1. An internal combustion engine system comprising:

an engine head having formed therein a plurality of fuel injector bores;

a fuel supply including a pressurized fuel supply conduit;

a fuel return conduit fluidly connected to the fuel supply;

a plurality of fuel injectors positioned in the plurality of fuel injector bores;

each of the plurality of fuel injectors having formed therein an actuation fuel supply passage fluidly connected to the pressurized fuel supply conduit, a pressure control passage, a plunger control passage, a nozzle fuel supply passage extending between a plunger cavity and a nozzle outlet, and at least one actuation fuel outlet;

each of the plurality of fuel injectors further including an intensifier plunger, a nozzle check, an injection control valve, and an intensifier control valve;

a plurality of fuel recovery fittings coupled to the plurality of fuel injectors and each having a recovered fuel outlet fluidly connecting to the fuel return conduit; and a plurality of fuel collection cavities each formed, outside of the respective fuel injector, between one of the plurality of fuel recovery fittings and the respective fuel injector, and fluidly connecting the at least one actuation fuel outlet in the respective fuel injector to the corresponding recovered fuel outlet.

2. The engine system of claim 1 further comprising a plurality of fuel seals formed between the plurality of fuel recovery fittings and the respective fuel injectors.

3. The engine system of claim 2 further comprising a valve cover, and a space is formed between the valve cover and the engine head and each of the plurality of fuel recovery fittings is positioned at least partially within the space.

4. The engine system of claim 3 wherein each of the plurality of fuel recovery fittings includes a sleeve portion arranged coaxially with the fuel injector, and a projecting side tube having therein the recovered fuel outlet.

5. The engine system of claim 4 wherein each of the plurality of fuel recovery fittings includes a flange, and the fuel seal fluidly seals between the flange and the fuel injector and between the flange and the engine head.

6. The engine system of claim 4 wherein the sleeve portion has an inside surface, the fuel injector includes a control valve subassembly having an outside surface, and the fuel collection cavity extends within the sleeve portion between the inside surface and the outside surface.

7. The engine system of claim 6 wherein each of the fuel injectors includes an injector housing having an injector body, and the injector body has the plunger cavity formed therein and the fuel seal fluidly seals between the sleeve portion and the injector body.

8. The engine system of claim 6 wherein the at least one actuation fuel outlet includes a drain port and a fuel leakage path formed in the control valve subassembly, and each of the drain port and the fuel leakage path is fluidly connected to the fuel collection cavity.

9. The fuel system of claim 1 wherein:

the injector housing further has formed therein an actuation fuel inlet fluidly connected to the pressurized fuel conduit within the engine head, and a nozzle fuel inlet separate from the actuation fuel inlet and fluidly connected to the nozzle fuel supply passage; and the pressurized fuel supply conduit includes a higher pressure fuel supply conduit, and further comprising a lower pressure fuel supply conduit fluidly connected to the nozzle fuel inlet.

10. A fuel injector assembly comprising:

an injector housing having formed therein an actuation fuel supply passage, a pressure control passage, an intensifier passage, a nozzle fuel supply passage extending between a plunger cavity and a nozzle outlet, and at least one actuation fuel outlet;

an intensifier plunger having an actuation surface exposed to the intensifier passage, and a pressurization surface exposed to the plunger cavity;

a nozzle check movable between a closed check position blocking the nozzle outlet, and an open check position, and having a closing hydraulic surface exposed to a fluid pressure of the pressure control passage;

an injection control valve movable between a first control valve position, where the pressure control passage is fluidly connected to the actuation fuel supply passage, and a second control valve position, where the pressure control passage is blocked from the actuation fuel supply passage and fluidly connected to the at least one actuation fuel outlet;

an intensifier control valve;

a fuel recovery fitting, having a recovered fuel outlet, coupled to the injector housing and fluidly connecting the at least one actuation fuel outlet to the recovered fuel outlet; and the fuel recovery fitting includes a sleeve portion coaxially arranged with the injector housing and having an inside surface, and a projecting side tube having the recovered fuel outlet formed therein, and the fuel injector includes a control valve subassembly having an outside surface, and a fuel collection cavity extends between the inside surface and the outside surface.

11. The fuel injector assembly of claim 10 wherein the at least one actuation fuel outlet includes a drain port, and a fuel leakage path formed in the control valve subassembly, and each of the drain port and the fuel leakage path is fluidly connected to the fuel collection cavity.

12. The fuel injector assembly of claim 11 wherein the injector housing further has formed therein a three-way valve seat positioned fluidly amongst the pressure control passage, the actuation fuel supply passage, and the drain port, and the injection control valve blocks the three-way valve seat at the first control valve position, and does not block the three-way valve seat at the second control valve position.

13. The fuel injector assembly of claim 10 wherein the fuel recovery fitting includes a flange, and further comprising a fuel seal between the flange and the fuel injector.

14. The fuel injector assembly of claim 13 wherein the injector housing further includes an injector body having the plunger cavity formed therein, and the fuel seal fluidly seals between the flange and the injector body.

15. A method of operating a common rail fuel system in an internal combustion engine comprising:

moving a control valve in a fuel injector between a first control valve position and a second control valve position to vary a pressure of fuel in a pressure control passage in the fuel injector;

opening a nozzle check in the fuel injector based on a reduction in the pressure of fuel in the pressure control passage caused by the moving of the control valve;

varying a flow of fuel through a spool valve in the fuel injector based on the varying of the pressure of fuel in the pressure control passage;

varying a rate of advancement of an intensifier plunger through a plunger cavity in the fuel injector based on the varied flow of fuel through the spool valve;

injecting fuel from the plunger cavity through a nozzle outlet in the fuel injector opened by the opening of the nozzle check at a fuel injection rate having a rate shape that is based on the varied rate of advancement of the intensifier plunger;

recovering fuel from at least one actuation fuel outlet of the fuel injector in a fuel recovery fitting coupled with the fuel injector; and fluidly sealing the fuel recovery fitting with a fuel seal between the fuel recovery fitting and an engine head of the internal combustion engine.

16. The method of claim 15 wherein the recovering of fuel further includes recovering fuel from a drain port opened to the pressure control passage based on the moving of the control valve.

17. The method of claim 16 wherein the recovering of fuel further includes recovering fuel from a fuel leakage path defined in part by the control valve, in a fuel collection cavity formed by the fuel recovery fitting.

18. The method of claim 16 further comprising fluidly sealing the fuel recovery fitting with a fuel seal between a flange of the fuel recovery fitting and an injector body of the fuel injector.

19. The method of claim 17 wherein the fuel recovery fitting is coupled to the fuel injector and exposed to a space extending between an engine head receiving the fuel injector and a valve cover.

* * * * *